United States Patent [19]

A'Costa

[11] Patent Number: 5,005,463

[45] Date of Patent: Apr. 9, 1991

[54] FLASH SUPPRESSOR FOR FIREARMS

[76] Inventor: Anthony A'Costa, P.O. Box 5806, 710 W. 4th St., Ste. E, Pueblo, Colo. 81003

[21] Appl. No.: 48,318

[22] Filed: May 11, 1987

[51] Int. Cl.[5] ..... F41A 21/34

[52] U.S. Cl. ..... 89/14.2; 89/14.3

[58] Field of Search ..... 89/14.2, 14.3, 14.4

[56] References Cited

U.S. PATENT DOCUMENTS

| | | | |
|---|---|---|---|
| 32,685 | 7/1861 | De Brame | 89/14.2 |
| 37,193 | 12/1862 | Alsop | 42/78 |
| 2,900,875 | 8/1959 | Fergus et al. | 89/14.3 |
| 3,455,203 | 7/1969 | Pillersdorf | 89/14.3 |
| 4,570,529 | 2/1968 | A'Costa | 89/14.2 |
| 4,664,014 | 5/1987 | Hawley et al. | 89/14.2 |

FOREIGN PATENT DOCUMENTS

| | | | |
|---|---|---|---|
| 633617 | 10/1983 | Belgium | 89/14.2 |
| 475519 | 5/1915 | France | 89/14.4 |
| 215 | 1/1985 | PCT Int'l Appl. | 89/14.3 |
| 1391 | of 1912 | United Kingdom | 89/14.3 |

OTHER PUBLICATIONS

Ezell, Edward C., Small Arms of the World, 1977, pp. 555, 565.

*Primary Examiner*—Stephen C. Bentley

*Attorney, Agent, or Firm*—Harold H. Dutton, Jr.

[57] ABSTRACT

An improved flash suppressor for attachment to the muzzle end of the barrel of a firearm comprising a generally cylindrical body member having a first portion adapted to receive a projectile from the barrel and a second portion adapted to receive a projectile from the first portion, the first portion having a longitudinal smoothbore passage therethrough through which a projectile discharged from the barrel passes, the second portion having a longitudinal passage with an inside diameter significantly greater than the inside diameter of the first portion passage, a smooth tapered transition wall connecting the longitudinal passages of the first and second portions, a pair of diametrically opposed longitudinal vent slots in the second portion and extending from the distal end of the second portion toward the first portion whereby the second portion comprises a pair of furcations, and at least one radially directed vent opening formed in each of the furcations.

8 Claims, 1 Drawing Sheet

FIG. 1
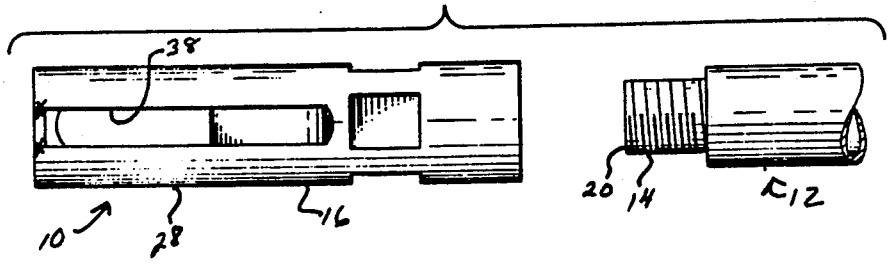
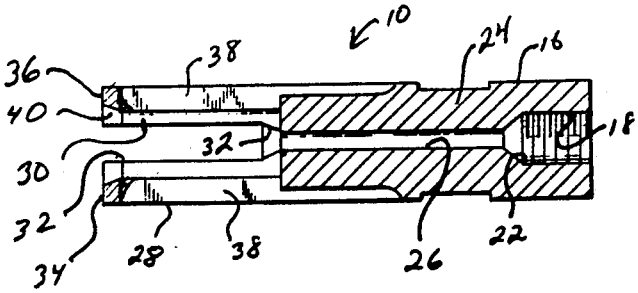
FIG. 2
FIG. 3
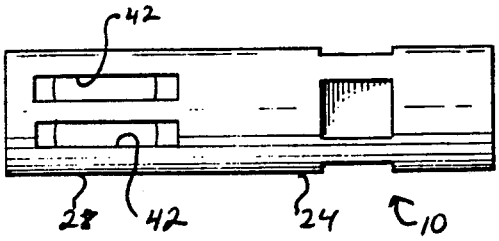
FIG. 4
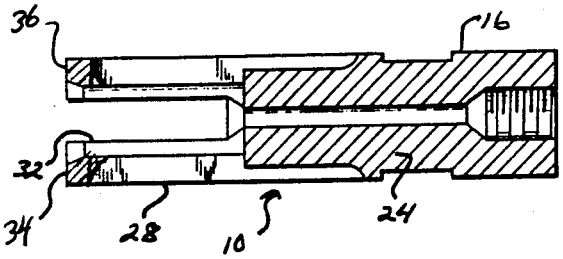
FIG. 5
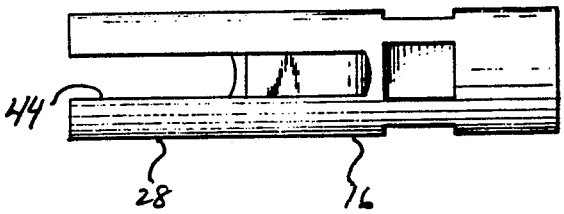
FIG. 6
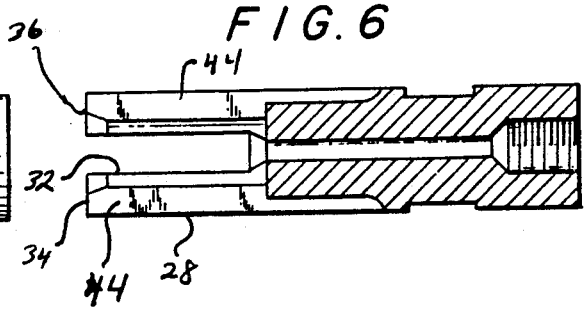

FLASH SUPPRESSOR FOR FIREARMS

This invention relates to a flash suppressor for firearms. More particularly, this invention relates to a flash suppressor of the type adapted to be attached to or removed from the muzzle end of a firearm such as a rifle, a pistol and larger weapons such as cannons and the like.

BACKGROUND AND OBJECTS OF THE INVENTION

In the past, many different types of devices have been proposed for attachment to the muzzle end of the barrels of firearms for accomplishing a variety of purposes. Most notably, such devices have been intended for reducing or silencing the noise produced by the firing of the weapon or for reducing the recoil of the gun. Some such attachments have been proposed for stabilizing the flight of the projectile.

For example, Durnford U.S. Pat. No. 587,802 and Fosberry U.S. Pat. No. 323,303 disclose attachments for shotgun type barrels for stabilizing a single projectile when used in such weapons, whereas Alsop U.S. Pat. 37,193 discloses a rifled section of barrel attached to the end of a smoothbore section to stabilize the projectile.

Another early effort resulted in DeBrame U.S. Pat. 32,685, which provided a so-called "skeleton" barrel, in which the groove portions of the barrel were removed leaving only the land portions separated by slots. The purpose was to reduce gas pressure in the barrel and to reduce friction.

Belgium patent No. 633,617 relates to a flash suppressor attached to the end of a barrel, and having a flared opening provided with slots in the flared portion as opposed to the cylindrical portion of the walls.

An early flash "hider" is disclosed in Burton U.S. Pat. No. 1,283,465, this device being little more than an enlarged extension of the muzzle end to literally (and hopefully) "hide" the muzzle flash. Experience has determined, however, that the ability to hide the flash by such a device is rather limited, in that the flash, which is caused by unburned gases which ignite when they reach the outside air, continues beyond the practical end of such a device.

An improved flash suppressor is disclosed in applicant's prior U. S. Pat. No. 4,570,529 which provided the added benefit of increased muzzle velocity and accuracy of the projectile, by combining the use of a smoothbore barrel extension with a plurality of radial slots in an extended portion of the flash suppressor body to permit a fuller burn of the propellant before exiting the barrel, thereby reducing the flash.

The present invention provides an improvement over the applicant's prior Pat. No. 4,570,529 in terms of a still greater flash reduction, and with the additional benefits of reduced muzzle lift on firing, reduced blowback of gases into the barrel, and a cooler barrel during prolonged firing, thus further enabling the use of lighter weight alloys for the barrel.

Accordingly, a primary object of the present invention is to provide an improved flash suppressor for firearms.

Another object of the invention is to provide an improved flash suppressor of the type adapted to be removably secured to the muzzle end of rifled barrels.

A further object of the invention is to provide a flash suppressor which reduces the muzzle jump or lift upon firing.

Still another object of the invention is to provide a flash suppressor of the type which uses a smoothbore extension of the conventional rifle gun barrel in combination with a further extension allowing dissipation of unburned gases without significant ignition thereof.

Yet a further object of the invention is to provide an improved flash suppressor which provides a cooler gun barrel during prolonged firing.

These and other objects and advantages of this invention will become apparent upon further consideration of the following description and claims along with the accompanying drawings.

DESCRIPTION OF THE INVENTION

The flash suppressor according to the present invention comprises a generally cylindrical body having an internally threaded bore at one end thereof and adapted to be screwed onto a correspondingly threaded extension at the muzzle end of the gun barrel. A first portion of the cylindrical body has a longitudinal smoothbore extending therethrough, and this passage directly receives the projectile as it exits the barrel. The internal diameter of this smoothbore preferably, but not necessarily, conforms to the teachings of U.S. Pat. No. 4,570,529. The length of the smoothbore passageway is readily determined as a function of the caliber of the weapon with which it is used.

Beyond the end of the first portion of the body is a second portion which also has a longitudinal passage through which the projectile travels. The internal diameter of this passageway in the second portion, however, is significantly greater than the diameter of the passageway through the first portion and likewise is significantly greater than the diameter of the projectile, such that no contact can occur between the projectile and the walls forming the passageway in this second portion.

A smooth, tapered wall connects the longitudinal passages in the first and second portions of the flash suppressor, this wall being preferably tapered at an angle of about 30° with respect to the longitudinal axis of the passageways. It has been found that this tapered transition wall between the first and second portions provides a significant benefit in allowing a controlled expansion of the gases exiting the barrel, thereby minimizing the suddenness of the expansion and reducing the likelihood that the unburned gases will ignite.

The second portion of the flash suppressor body is further characterized by a pair of diametrically opposed, longitudinally extending vent slots which extend from the distal end of the body toward the first portion of the body, and thereby divide the second portion into a pair of furcations.

Each of the furcations is also provided with at least one radially directed vent opening. In one embodiment, the flash suppressor then has four vent passages, two open ended vent slots and two closed ended vent slots. In another embodiment, a pair of closed-ended vent slots are provided in each of the furcations, so that there are two open-ended slots and four closed-ended slots. In still another embodiment, the two slots in the two furcations are extended to the distal end of the flash suppressor so that these latter two slots are open-ended, thus providing the flash suppressor with a total of four open-ended slots.

In another preferred embodiment, a slight flaring of the distal end of the passageway through the second portion of the flash suppressor is provided, to provide for still further controlled expansion of gases.

While certainly the flash suppressor according to this invention may be made of conventional gun barrel type steel, applicant has found that the flash suppressor according to the invention may also be made from a lightweight aluminum alloy, which is an added benefit of the invention.

DESCRIPTION OF THE DRAWINGS

The invention will be further described and understood with respect to the accompanying drawings, in which:

FIG. 1 is an exploded plan view of a flash suppressor according to this invention, showing the manner in which it may be attached to the muzzle of a gun barrel;

FIG. 2 is a longitudinal cross-sectional view of the flash suppressor of FIG. 1;

FIG. 3 is a plan view of another embodiment of a flash suppressor according to the invention;

FIG. 4 is a longitudinal cross-sectional view of the flash suppressor of FIG. 3;

FIG. 5 is a plan view of still another embodiment of a flash suppressor according to the invention; and FIG. 6 is a longitudinal cross-sectional view of the flash suppressor of FIG. 5.

DESCRIPTION OF PREFERRED EMBODIMENTS

The invention will now be described in reference to the accompanying drawings.

As seen in FIG. 1, the invention comprises a flash suppressor generally designated 10 which is intended to be attached to the muzzle end of a barrel generally designated 12. The barrel is provided with a male threaded extension 14 in a conventional manner for receiving the flash suppressor 10. The flash suppressor 10 comprises a generally cylindrical body member 16 which has a threaded recess 18 for receiving the extension 14 of the gun barrel 12. The flash suppressor body 16 is simply threaded on to the gun barrel in a conventional manner, until the front 20 of the gun barrel contacts the end 22 of the threads in the recess 18.

The body member 16 is provided with a first portion 24 which has a longitudinally extending, axial passageway 26 therethrough. The passageway 26 receives a projectile from the muzzle end 20 of the barrel 12, and the projectile passes through the passageway 26 as it exits the gun. The passageway 26 is of a smooth-bore configuration, meaning that it does not have rifling grooves therein, as is the case with a conventional gun barrel design. The diameter of the passageway 26 is so sized in relation to the caliber of the gun barrel 12 as to properly receive the projectile. The sizing may be in accordance with the disclosure of U.S. Pat. No. 4,570,529.

A second portion 28 of the flash suppressor 10 is provided with another longitudinally extending passageway 30. The passageway 30 is of a significantly greater internal diameter than the passageway 26, such that the projectile does not contact any portion of the flash suppressor after it exits the passageway 26.

A smooth, tapered transition wall 32 is provided, beginning at the left end of the passageway 26, as seen in FIG. 2, and tapering outwardly towards the passageway 30. This transition wall is preferably at an angle of about 30° to the longitudinal axis of the flash suppressor or the trajectory path of the projectile. This transition wall 32 allows a gradual expansion of the gases exiting the gun barrel 12 and the passageway 26, as opposed to a sudden abrupt increase in diameters which would then allow a rather uncontrolled expansion of the gases.

A pair of diametrically opposed, longitudinal vent slots 33 are provided in the second portion 28 of the flash suppressor 10. These slots 33 divide the second portion into two furcations 34 and 36 extending toward the distal end of the flash suppressor from the first portion 24 of the body 16. Each of the furcations 34 and 36 is then provided with a radially directed vent opening or slot 38. Gases are allowed to exit from the passageway 30 either through the slots 33 or the slots 38. Thus, it will be seen that the embodiment of FIGS. 1 and 2 is provided with two slots 33 which are open at their distal end, and two slots 38 which are closed at their distal end.

The passageway 30 is also provided at its exit end with a flared wall surface 40, which again serves to assure a controlled expansion of the gases exiting the gun barrel. Again, preferably, the flared wall 40 would be machined at an angle of about 30° to the longitudinal axis of the flash suppressor 10.

In the embodiment of FIGS. 3 and 4, the first portion 24 of the body member 16 is the same as in the embodiment of FIGS. 1 and 2, and that the second portion 28 is likewise the same, with the exception of the vent slots provided. A pair of diametrically opposed, longitudinally extending vent slots 33 are also provided, however the closed vent slots 38 are replaced by a pair of slots 42 in each furcation. In this embodiment, then, the flash suppressor 10 is provided with two open-ended vent slots 33 which divide the second portion of the body member into two furcations 34 and 36, and each of the furcations is then provided with two closed-end vent slots 42.

The embodiment of FIGS. 5 and 6 again is similar to the embodiment of FIGS. 1 and 2, but here, each of the furcations 34 and 36 is provided with a slot 44 which extends to the distal end of the body member 16, whereby the second portion 28 now has four open-ended vent passages.

While this invention has been described as having preferred features and embodiments, it will be apparent that it is capable of still further variation and modification without departing from the spirit of the invention, and this application is intended to cover any and all variations, modifications, and adaptations which fall within the spirit of the invention and the scope of the accompanying claims.

I claim:

1. A flash suppressor for attachment to the muzzle end of the barrel of a firearm comprising a generally cylindrical body member having a first portion for receiving a projectile from said barrel and a second portion for receiving a projectile from said first portion, said first portion having a longitudinal smoothbore passage therethrough through which a projectile discharged from said barrel passes, said second portion having a longitudinal passage with an inside diameter significantly greater than the inside diameter of said first portion passage, a smooth tapered transition wall connecting the longitudinal passages of said first and second portions, a pair of diametrically opposed longitudinal vent slots in said second portion and extending from the distal end of said second portion toward said first portion whereby said second portion comprises a pair of furnications, and at least one radially directed closed ended vent opening formed in each of said furcations.

2. A flash suppressor as in claim 1 and wherein said radially directed vent openings comprise elongate slots formed in said body member.

3. A flash suppressor as in claim 2 and wherein said elongate slots are open at the distal end of said second portion.

4. A flash suppressor as in claim 2 and wherein said elongate slots are closed at the distal end of said second portion.

5. A flash suppressor as in claim 2 and including a pair of said radially directed vent in each of said furcations.

6. A flash suppressor as in claim 4 and including a pair of said radially directed vent openings in each of said furcations.

7. A flash suppressor as in claim 1 and wherein said smooth tapered transition wall forms an angle of about 30° with the longitudinal axis of said body member.

8. A flash suppressor as in claim 1 and wherein said longitudinal passage in said second portion has an outwardly flaring wall at the distal end thereof.

* * * * *